US006186030B1

(12) United States Patent
Whitley

(10) Patent No.: US 6,186,030 B1
(45) Date of Patent: Feb. 13, 2001

(54) COMBINATION RATCHETING SOCKET WRENCH

(75) Inventor: Lowell Blake Whitley, Arlington, TX (US)

(73) Assignee: Stanley Works, New Britain, CT (US)

( * ) Notice: Under 35 U.S.C. 154(b), the term of this patent shall be extended for 0 days.

(21) Appl. No.: 09/361,053

(22) Filed: Jul. 26, 1999

(51) Int. Cl.[7] ..... B25B 13/00
(52) U.S. Cl. ..... 81/58.3; 81/63.2
(58) Field of Search ..... 81/58.3, 60, 61, 81/62, 63, 63.1, 63.2, 59.1, 125.1, 177.8, 177.9; 192/43, 43.2, 44, 45

(56) References Cited

U.S. PATENT DOCUMENTS

| | | | | |
|---|---|---|---|---|
| 4,030,384 | * | 6/1977 | Newman | 81/58.3 |
| 4,612,830 | * | 9/1986 | Yang | 81/63.2 |
| 4,631,988 | | 12/1986 | Colvin . | |
| 4,819,521 | | 4/1989 | Lang . | |
| 5,157,994 | | 10/1992 | Krivec . | |
| 5,174,176 | | 12/1992 | Krivec . | |
| 5,203,240 | * | 4/1993 | Sorter | 81/63.2 |
| 5,249,487 | | 10/1993 | Armfield . | |
| 5,339,711 | * | 8/1994 | Shu | 81/63 |
| 5,477,757 | * | 12/1995 | Maresh | 81/63.2 |
| 5,495,783 | | 3/1996 | Slusar et al. . | |
| 5,568,751 | * | 10/1996 | Lee | 81/63 |
| 5,642,794 | * | 7/1997 | Chuang et al. | 192/43 |
| 5,784,934 | | 7/1998 | Izumisawa . | |
| 5,829,327 | | 11/1998 | Stanton . | |
| 5,836,430 | | 11/1998 | Vasudeva . | |
| 5,842,391 | | 12/1998 | Chaconas . | |
| 5,848,680 | | 12/1998 | Rinner . | |
| 5,850,767 | | 12/1998 | Newman . | |
| 5,878,635 | * | 3/1999 | Hsieh | 81/61 |
| 5,957,009 | * | 9/1999 | McCann | 81/63.2 |
| 5,960,680 | * | 10/1999 | Chen et al. | 81/63.2 |
| 5,964,129 | * | 10/1999 | Shiao | 81/63.2 |

* cited by examiner

*Primary Examiner*—Timothy V. Eley
*Assistant Examiner*—Dung Van Nguyen
(74) *Attorney, Agent, or Firm*—Pillsbury Madison & Sutro LLP

(57) ABSTRACT

An open-end or box wrench with a ratcheting socket wrench at the opposite end of the wrench handle. The ratcheting socket wrench may be either fixedly or pivotally attached. In one embodiment of the invention, a socket is permanently affixed to the ratchet mechanism. In another embodiment of the invention, a drive member for releasable attachment to sockets is permanently affixed to the ratchet mechanism. In either embodiment, the ratchet mechanism is preferably reversible.

49 Claims, 7 Drawing Sheets

COMBINATION RATCHETING SOCKET WRENCH

BACKGROUND AND SUMMARY OF THE INVENTION

Wrenches are available in a wide variety of styles and sizes. The most common types of wrenches are likely the open-end wrench and the box wrench. The open-end wrench has an opening of particular size and two parallel sides for engaging opposite sides of a fastener. The box wrench generally has a polygonal opening for contacting the circumferential surfaces of a fastener. Both of these wrenches are widely known in the art.

There also exist ratcheting socket wrenches, which hasten the process of inserting or removing a fastener considerably since ratcheting socket wrenches do not require that the wrench be removed from the fastener at the end of each turn. Ratcheting socket wrenches also have the advantage of being employable for a variety of fasteners, as sockets of diverse size may be releasably attached to the ratcheting body.

The disadvantage of most ratcheting socket wrenches is their size. Many times the ratchet and socket mechanism simply will not fit into the work envelope. Another common problem is that many times the insertion or removal of a fastener may be initiated with a ratcheting socket wrench, yet an open-end or box wrench is often required to finish the process. Such a situation may occur when, for example, space limitations around a fastener increase as the fastener's head position changes during insertion or removal. In this situation it is common to have and employ, both a ratcheting socket wrench and an open-end or box wrench. This entails the purchase of a wrench and a socket for each fastener size. Storage space becomes an issue, and there is the added annoyance of assuring that both wrench types are accessible when needed.

One aspect of the present invention is the elimination of the need for separate sockets and wrenches for the same fastener size. Another aspect of the present invention is a device that conveniently combines the benefits of both types of wrenches on one handle, thereby eliminating the need to search for and have available a second wrench.

The present invention contemplates a wrench having an open-end or box wrench at one end and a ratcheting socket wrench at the opposite end. The ratcheting socket wrench portion is made to pivot about the wrench handle to provide maximum flexibility of use.

In one embodiment of the present invention, the ratcheting socket wrench has a socket which is permanently affixed to the ratcheting body and fits the same size fastener as the open-end or box wrench on the opposite side of the wrench handle. In the preferred embodiment of the invention, the ratcheting direction of the ratcheting socket wrench may be reversed by pulling axially downward on the socket and turning the socket slightly left or right as required.

In another embodiment of the present invention, a coupling member replaces the socket member. The coupling member is designed for releasable attachment to common sockets, thus allowing the ratcheting socket wrench to be used on fasteners of various size. The ratcheting mechanism may be designed for use with a particular range of socket sizes based on the size of the open-end or box wrench portion. This would eliminate the need for installing on every wrench, a ratcheting mechanism capable of withstanding the load of an entire socket size range. In this embodiment of the invention, the ratcheting direction of the ratcheting socket wrench may also be reversed by pulling axially downward on the socket and turning the socket slightly left or right as required.

BRIEF DESCRIPTION OF THE DRAWINGS

The invention and its attendant objects and advantages will become better understood upon reading the following description of the preferred embodiments in connection with the following drawings, wherein.

DETAILED DESCRIPTION OF THE PREFERRED EMBODIMENT(S)

Figure 1:
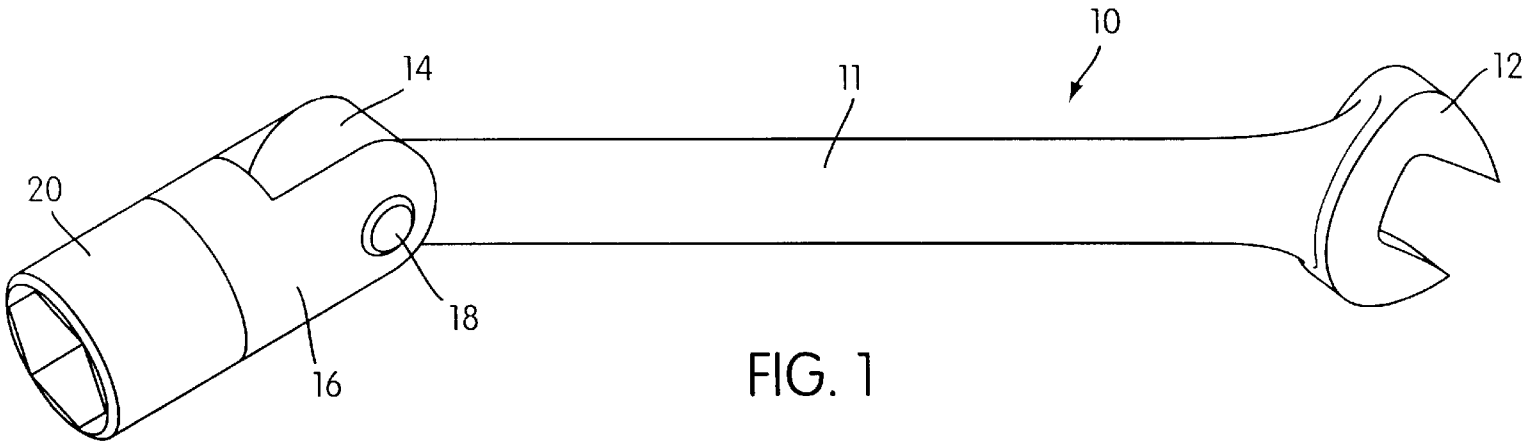
FIG. 1 shows one embodiment of the combination ratcheting socket wrench as contemplated by the present invention, wherein the wrench handle terminates at one end in an open-end wrench.
Figure 1B:
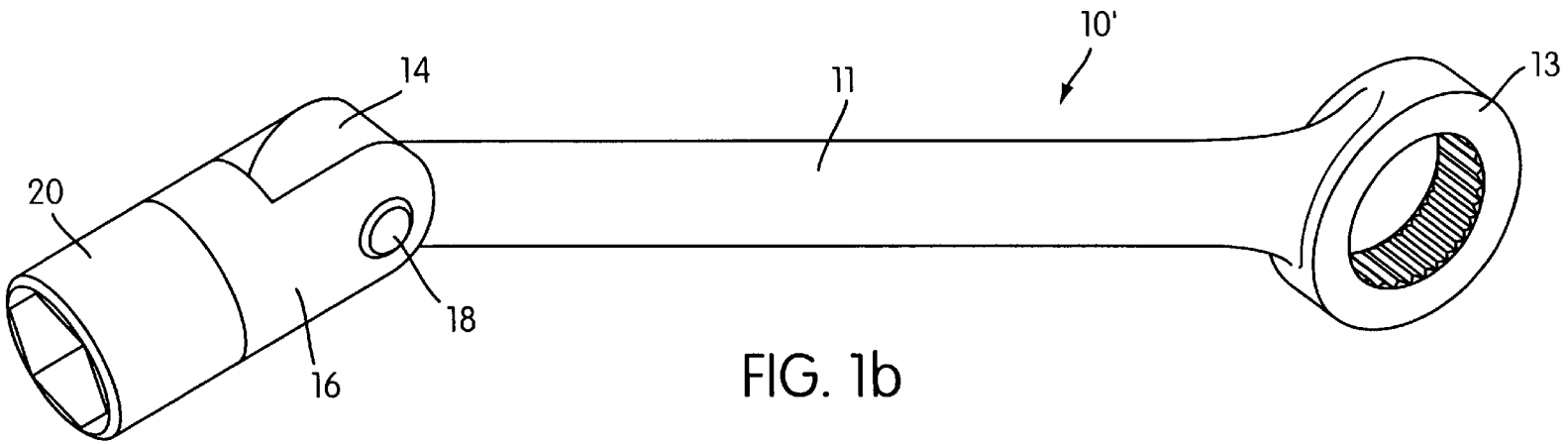
FIG. 1*b* is an alternative embodiment of the combination ratcheting socket wrench as contemplated by the present invention, wherein the wrench handle terminates at one end in a box wrench.

FIG. 1 shows a preferred embodiment of the assembled combination ratcheting socket wrench 10 of the present invention. The wrench is comprised of a handle 11, which terminates at a first end in an open-end wrench 12 and at a second end in a pivot-forming structure 14. FIG. 1*b* is illustrative of an alternate embodiment 10 of the present invention, in which the wrench handle 11 terminates at a first end in a box wrench 13, and at a second end in the same pivot-forming structure 14 as shown in FIG. 1.

Figure 5:
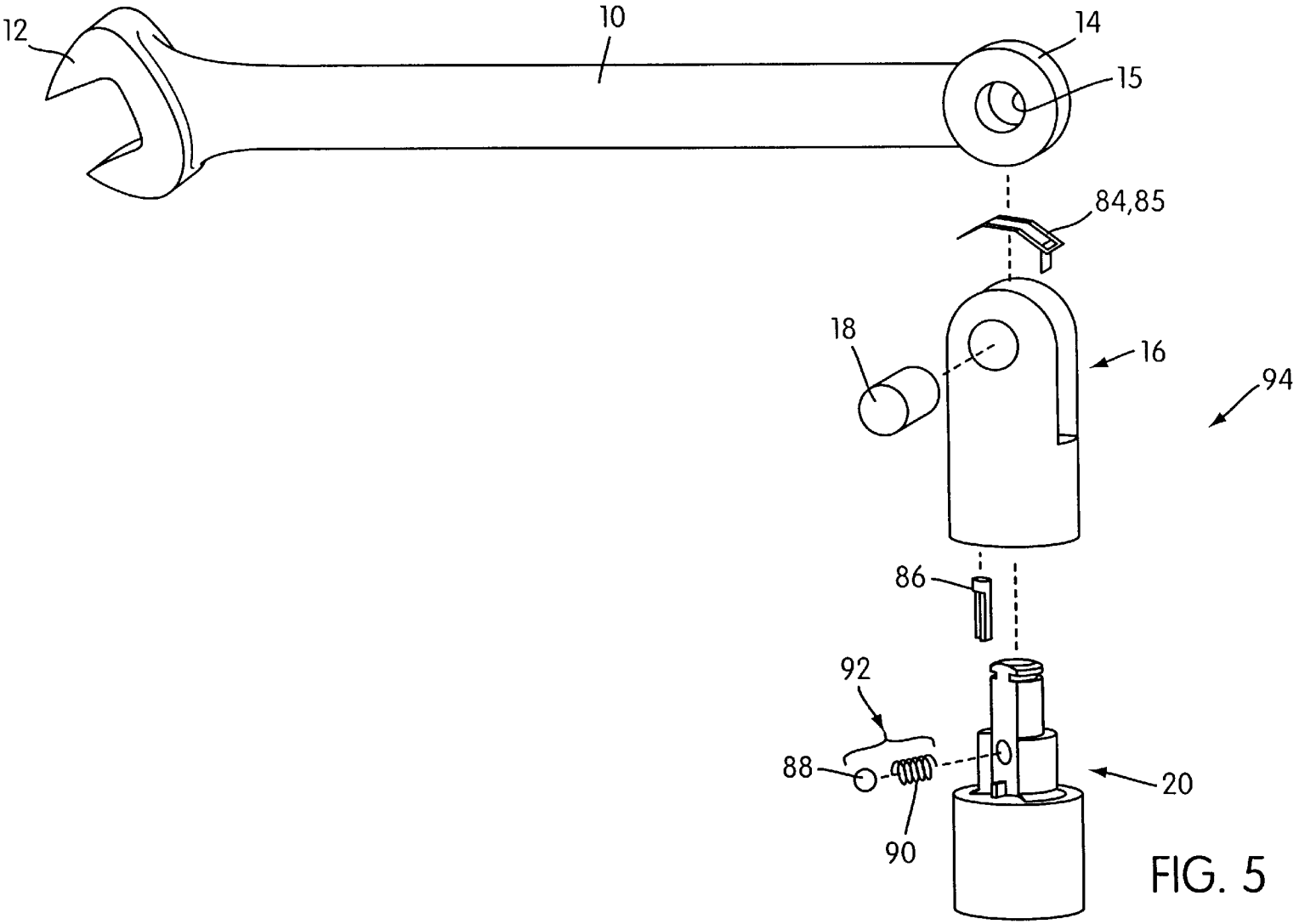
FIG. 5 is an exploded assembly view showing the individual components of the present invention.

Referring briefly to FIG. 5, it can be seen that the pivot-forming structure 14 may be of various shape, such as the circular form herein depicted. A hole 15 is existent through the pivot-forming structure 14 for forming a pivoting joint.

Figure 2B:
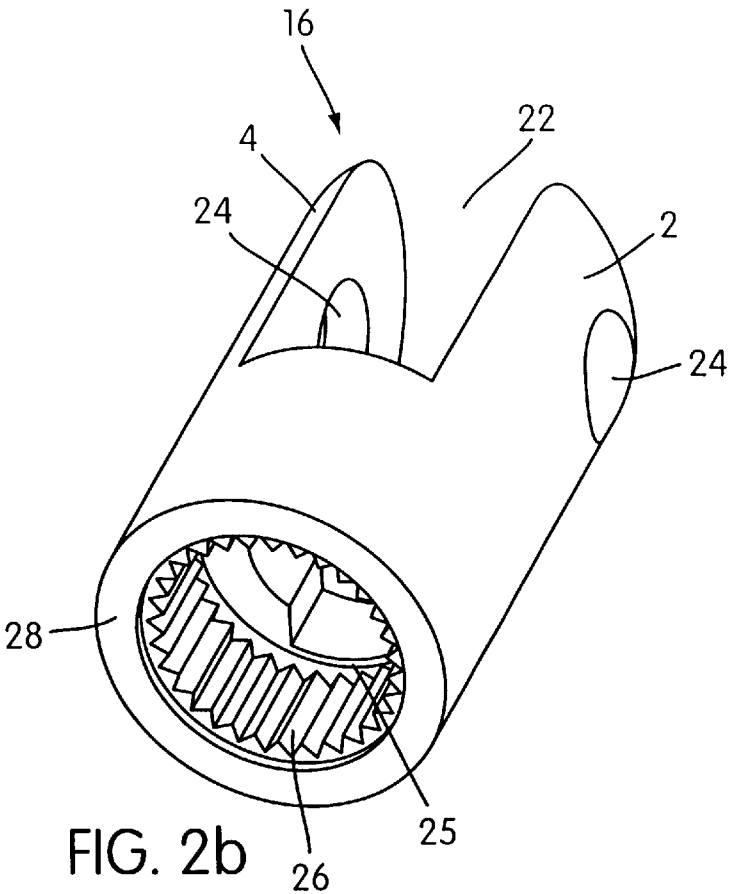
FIGS. 2*a* and 2*b* consist of two views of the ratchet body designed to engage with and pivot about the wrench handle.
Figure 2A:
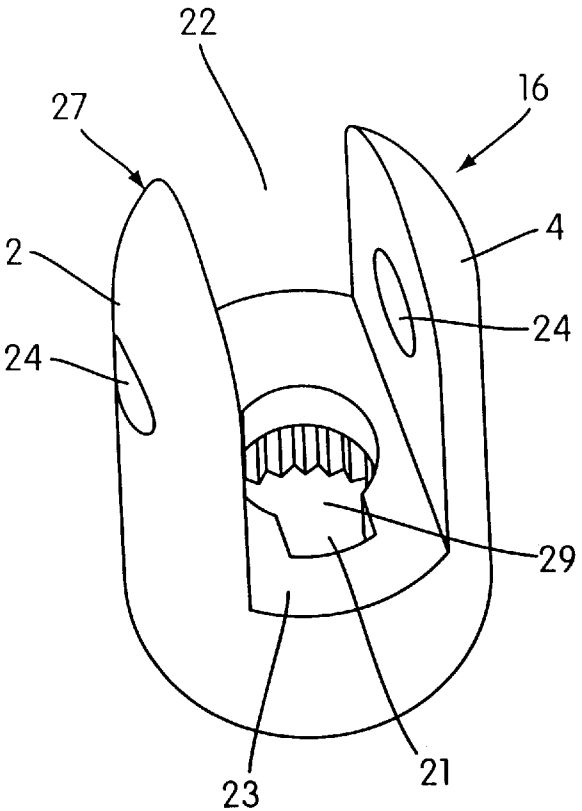

Referring again to FIG. 1, a ratchet body 16 is coupled to the pivot-forming structure 14 of the wrench handle 11. As can be seen in FIGS. 2*a* and 2*b*, the ratchet body 16 is preferably externally cylindrical and of some height. There is a slot 22 passing through the ratchet body 16 at a first end 27. The slot 22 direction is along a first diameter of the ratchet body 16, and of sufficient size to allow insertion and pivoting of the pivot-forming structure 14 of the wrench handle 11.

The ratchet body 16 is provided with a hole 24 located toward the first end 27 of the ratchet body. The axis of the hole 24 lies along a second diameter of the ratchet body 16. The second diameter is oriented such that the hole 24 passes through each of the sections 2, 4 of the ratchet body 16 forming the lateral edges of the slot 22. The hole 24 in the ratchet body 16 is further located to be axially aligned with the hole 15 (FIG. 5) in the pivot-forming structure 14 when the pivot forming structure 14 is properly inserted into the slot 22 of the ratchet body 16.

Upon proper alignment of the hole 24 and the hole 15 (FIG. 5), a pin 18 is inserted through both the ratchet body 16 and the pivot forming structure 14. Together, the pivot-forming structure 14, ratchet body 16, and pin 18 form a pivoting joint allowing the ratchet body 16 to pivot about the wrench handle 11.

The ratchet body 16 is provided with an internal bore at the second end 28. The internal bore has a diameter less than the outer diameter of the ratchet body 16, such that a cylindrical wall is formed within the ratchet body 16 at the second end 28. There are splines 26 located along the inner circumference of the cylindrical wall. The splines 26 extend axially some distance from the second end 28 toward the first end 27 of the ratchet body 16.

A shelf 23 of some thickness is formed between the bottom of the slot 22 and the end of the internal bore of the ratchet body 16. A hole 29, centered about the axis of the ratchet body 16, passes through the shelf 23. In a preferred embodiment of the invention, there is a notch 21 extending from the hole 29 along the first diameter of the ratchet body 16. The notch 21 is preferably of square or rectangular shape and of a width less than the diameter of the hole 29. The notch 21 may pass partially or entirely through the shelf 23.

Figure 6:
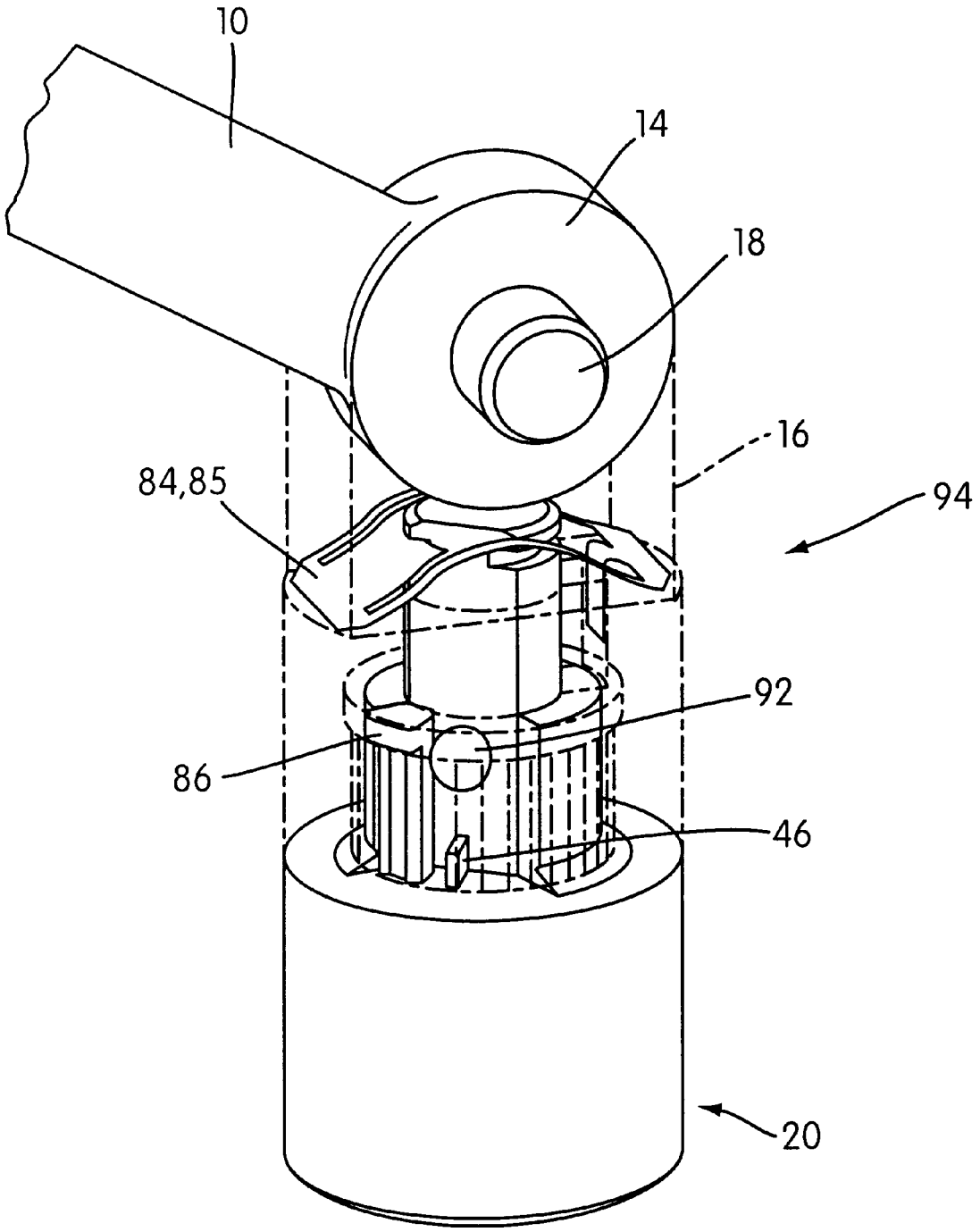
FIG. 6 is an enlarged view of the ratcheting device installed on the wrench handle, wherein the ratchet body is depicted as transparent.

There is also a circumferential groove 25 around the inner cylindrical wall of the ratchet body 16. The groove 25 is located between the end of the splines 26 and the end of the internal bore. The groove 25 is of some diameter, less than the outer diameter of the ratchet body 16, and of some height sufficient to receive a section 108 of a pawl 86 (FIGS. 5 and 7) utilized in the ratcheting device 94 (FIGS. 5 and 6).

Figure 3B:
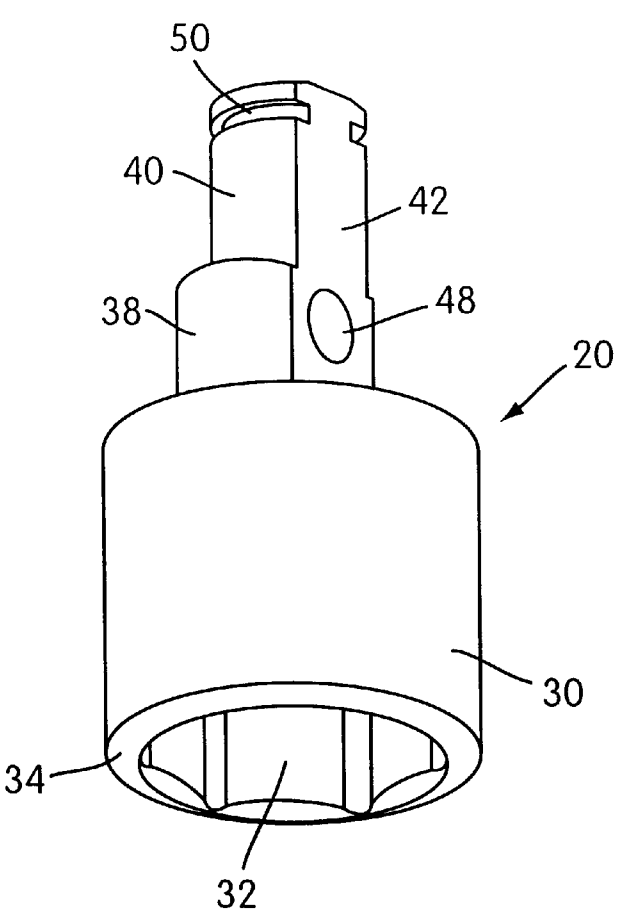
FIGS. 3*a* and 3*b* depict two views of the socket member, which is affixed to the ratchet body in one embodiment of the present invention.
Figure 3A:
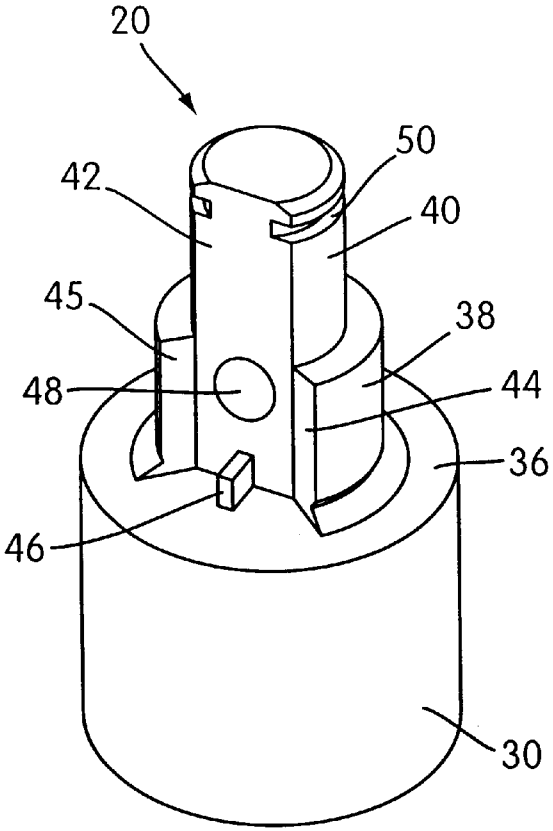

As illustrated in FIG. 1, there is a socket member 20 affixed to the second end 28 of the ratchet body 16. The structure of the socket member 20, as shown in FIGS. 3*a* and 3*b*, allows for its insertion into the ratchet body 16.

The socket member 20 is comprised of several cylindrical portions, forming substantially a stepped shaft. The socket member 20 has a first cylindrical portion 30 of some height. There is a recess 32 of polygonal or other shape located within the first end 34 of the socket member 20. The recess 32 is employed to engage a fastener.

A second cylindrical portion 38 extends axially some height from the center of the second end 36 of the first cylindrical portion 30. The second cylindrical portion 38 has a lesser diameter than the first cylindrical portion 30.

A third cylindrical portion 40 extends axially some height from the center of the free end of the second cylindrical portion 38. The third cylindrical portion 40 has a lesser diameter than the second cylindrical portion 38. The third cylindrical portion is designed to contact a socket-biasing member 84 (FIGS. 5 and 6) located within the ratchet body 16. In a preferred embodiment depicted in FIGS. 3*a* and 3*b*, the third cylindrical portion has an outer circumferential groove 50 located toward its free end. The groove 50 is provided to attach the socket member 20 to a biasing member, such as 84.

Referring again to FIGS. 3*a* and 3*b*, it can be seen that a portion of the circumference of both the second cylindrical portion 38 and the third cylindrical portion 40 is removed to some depth, forming a flat surface 42. The flat surface 42 is parallel to the axis of the socket member 20 and extends from the top surface of the first cylindrical portion 36 to the free end of the third cylindrical portion 40. The flat surface 42 is oriented to lie in a single plane; therefore, its depth, as measured from the outer surface, is greater in the second cylindrical portion 38 than in the third cylindrical portion 40.

There is also a wall section 44, 45 formed adjacent to each of both edges of the flat surface occurring in the second cylindrical portion 38. Each wall section 44, 45 extends radially outward from its respective line of the intersection formed by the flat surface 42 and the second cylindrical portion 38. The radial direction of each wall section 44, 45 creates an angle with respect to the flat surface 42.

A tab 46 of some thickness rises vertically some distance from the top surface of the first cylindrical portion 36, while also extending some distance radially outward from the flat surface 42. The tab 46 is centered along the line formed by the intersection of the flat surface 46 with the top surface of the first cylindrical portion 36.

The socket member 20 also possesses a retaining structure 48 for retaining a pawl-biasing member 92, such as the combination of a ball bearing 88 and spring 90 as illustrated in FIG. 5. As shown in FIGS. 3*a* and 3*b*, the retaining structure 48 of the preferred embodiment comprises a hole in the flat surface 42. However, the retaining structure 48 could be a pin, a clip, a groove, or any number of other means for retaining a spring or other type of biasing member.

Figure 4B:
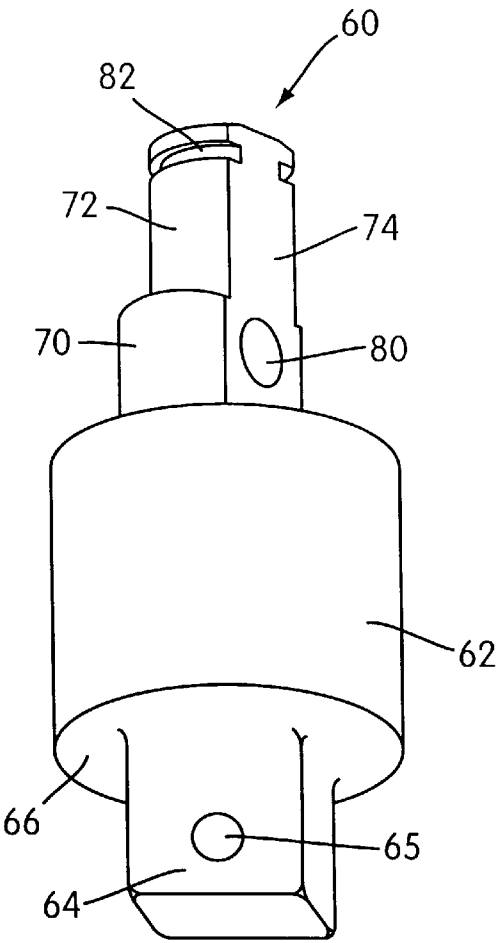
FIGS. 4*a* and 4*b* depict two views of the coupling member, which is affixed to the ratchet body in an alternate embodiment of the present invention.
Figure 4A:
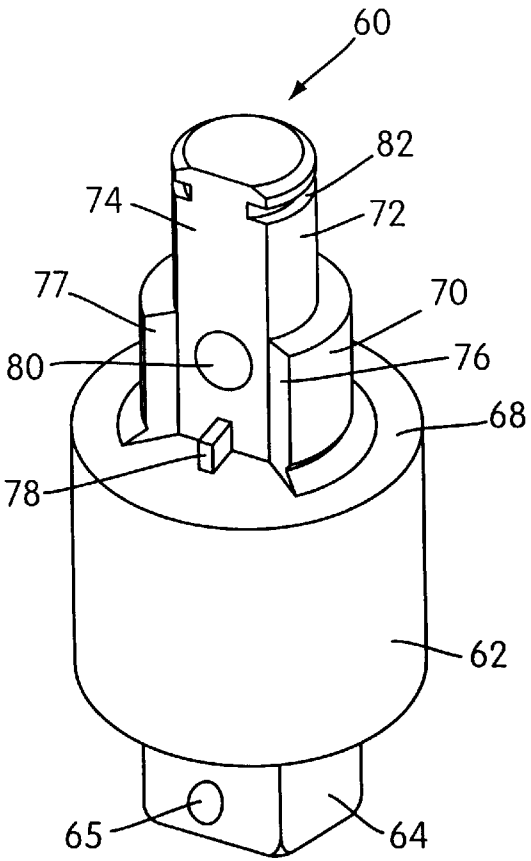

FIGS. 4*a* and 4*b* depict a coupling member 60, which may replace socket member 20 in an alternate embodiment of the present invention. The coupling member 60 is very similar to the socket member 20. The coupling member has a first cylindrical portion 62, preferably of similar diameter to the first cylindrical portion 30 of the socket member 20. The coupling member also has a second cylindrical portion 70, third cylindrical portion 72, flat surface 74, wall sections 76 and 77, tab 78, groove 82, and pawl-biasing member retaining structure 80 identical to those found in the socket member 20. For purposes of clarification only, when coupling member 60 is substituted for socket member 20, a biasing member identical to socket-biasing member 84 is also utilized, but will be referred to hereinafter as coupling-biasing member 85.

In contrast to socket member 20, however, coupling member 60 does not possess a recess in the first end 66. Rather, the coupling member has a male socket connector 64 designed to releasably attach to common sockets. The socket connector 64 may possess a spring-loaded ball 65 to aid in retention of the socket and may be utilized in various sizes to attach to smaller or larger sockets.

An advantage of the coupling member 60 is the ability to use sockets of different size with the wrench of the present invention. While the socket connector 64 may be made to attach to virtually any size socket, it is preferred that the size of the sockets used be related to the size of the open-end wrench 12 or box wrench 13 attached to the handle 11. Designing the wrench of the present invention for use with a clearly-stated range of socket sizes, eliminates the need to install a ratcheting mechanism capable of withstanding forces far in advance of those expected during use of the open-end 12 or box wrench 13 portions of the invention.

Figure 7:
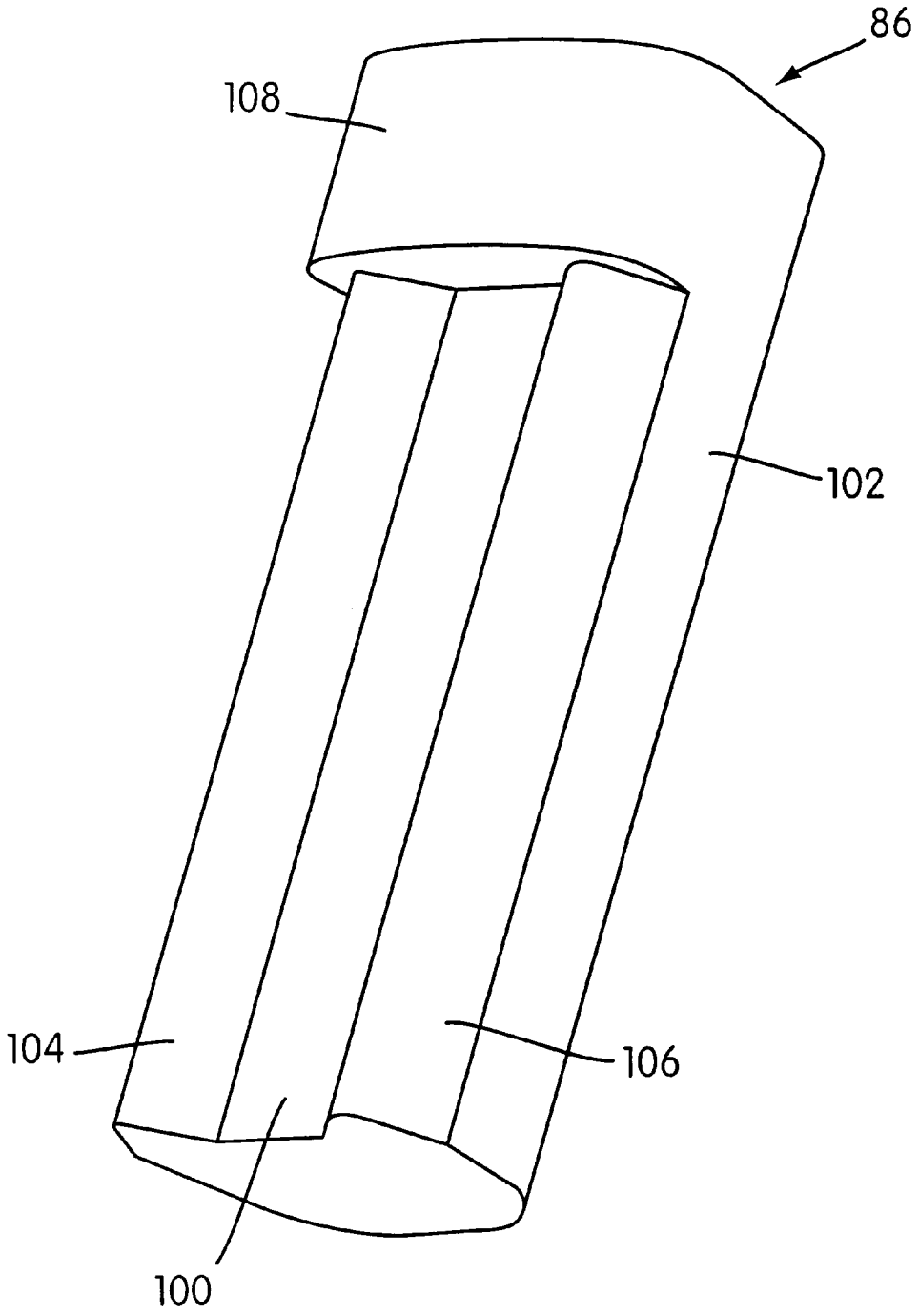
FIG. 7 is an enlarged view of the pawl used to provide the ratcheting action of the present invention.

A pawl 86, as can be seen in FIG. 7, is used to produce the ratcheting action of the present invention. In a preferred embodiment of the invention, the pawl 86 is of generally rectangular shape. There are two splines 104, 106 located on the front surface 100 of the pawl and designed to engage the splines 26 located in the ratchet body 16. The sides of the pawl 86 are angled, such that the front surface 100 of the pawl is wider than the back surface 102 of the pawl.

One end of the pawl terminates in a cap 108 of some thickness sufficient to slidably fit within the groove 25 located in the ratchet body 16. The cap 108 protrudes from the front surface 100 an amount sufficient to allow the pawl to be retained and guided by the groove 25 during operation of the wrench.

Together, the ratchet body 16, socket member 20, socket-biasing member 84, pawl 86, and pawl-biasing member 92 form a ratcheting socket device 94. Whether a socket member 20 or coupling member 60 is utilized, attachment to the ratchet body 16 may be identical. In the preferred embodiment of the invention depicted in FIGS. 5 and 6, the pawl 86 is placed in the ratchet body 16 such that the cap 108 of the pawl 86 resides in the groove 25. The socket member 20 is then inserted into the ratchet body 16. The design of the socket member 20 allows the third cylindrical portion 40 to protrude through the hole 29 in the shelf 23. A socket-biasing member 84, such as a retaining spring clip, is provided to reside above the hole 29 in the shelf 23. A tab located on the socket-biasing member 84 may extend into the notch 21 located in the shelf 23 to prevent rotation of the socket-biasing member. The socket-biasing member 84 is affixed to the third cylindrical portion 40 of the socket member 20 causing the socket-biasing member to be pulled toward the top of the shelf 23. As a result of the deflection of the socket-biasing member 84, a reaction force is exerted on the socket member 20, thereby urging the top surface 36 of the socket member into contact with the second end 28 of the ratchet body 16.

During installation of the socket member 20, the pawl 86 is trapped between the tab 46 and either one of the wall sections 44, 45 formed in the second cylindrical portion 38 of the socket member 20. The location of the pawl-biasing member 92 is such that it will tend to force one of the pawl splines 104, 106 into contact with the splines 26 in the ratchet body 16, by pivoting the pawl. In FIG. 6, the pawl 86 is shown to reside between the tab 46 and wall section 45. Any rotation of the socket member 20 will cause the pawl 86 to contact either the wall section 45 or the tab 46. When rotation of the socket member 20 brings the pawl 86 into contact with the wall section 45, the angled side of the pawl and the angle of wall section 45 form a wedge, which transfers the torque exerted by the handle 10 on the ratchet body 16 to the socket member 20.

Rotation in the opposite direction will bring the pawl into contact with the tab 46. The contact of the tab 46 with the angled side of the pawl 86 causes the pawl to pivot, compressing the pawl-biasing member 92. The pivoting of the pawl 86 removes pawl spline 106 from contact with the splines 26 of the ratchet body 16; thus allowing the handle 11 to be ratcheted in the reverse direction without exerting any force on the socket member 20.

The direction of the ratcheting mechanism 94 may be reversed by pulling down on the socket member 20, thereby causing a slight axial displacement of the socket member 20 away from the ratchet body 16. The amount of axial displacement need only be sufficient to allow the tab 46 to clear the pawl 86. In the embodiment of FIG. 6, reversal would require that the socket member be turned to the right, causing the pawl 86 to overcome the force of the pawl-biasing member 92 and move to the opposite side of the tab 46. The pawl 86 is then trapped between the tab 46 and wall section 44. The function of the pawl 86 in this location is identical to that described above, except that pawl spline 104, rather than pawl spline 106, will engage the splines 26 of the ratchet body 16. Releasing tension on the socket member 20 will allow the socket member to return to its biased position via the force of the socket-biasing member 84. As is well known in the art, once the direction of the ratcheting mechanism 94 is reversed, the wrench will act to transfer torque in the opposite direction.

The scope of the invention is not to be considered limited by the above disclosure, and modifications are possible without departing from the spirit of the invention as evidenced by the following claims.

What is claimed is:

1. A ratcheting socket wrench comprising:

a wrench body having a handle portion, said handle portion terminating at one end in a fastener engaging portion and at the other end in a pivot-forming structure;

a ratcheting device, with one end designed for pivotal connection to said pivot-forming structure of said wrench handle, said ratchet device further comprising:

(1) a ratchet body;

(2) a socket member;

(3) a socket-biasing member adapted to bias said socket member against said ratchet body, said socket member movably engaged with said ratchet body; and (4) a pawl, movably engaged with the inner circumference of said ratchet body, wherein said pawl is adapted to prevent movement of the ratchet device in a first direction when said pawl is in a first predetermined position, and wherein said pawl is adapted to prevent movement of the ratchet device in a second direction when said pawl is in a second predetermined position; and a pin provided to connect said wrench handle with said ratcheting device, such that said wrench handle, said ratcheting device, and said pin form a pivoting joint.

2. The wrench of claim 1 wherein said fastener engaging portion is an open-end wrench.

3. The wrench of claim 1 wherein said fastener engaging portion is a box wrench.

4. The wrench of claim 1 wherein said ratcheting device has a coupling member for releasably engaging a socket.

5. The wrench of claim 1 wherein said ratcheting device is reversible.

6. The wrench of claim 1 wherein said pivoting joint rotates in the same plane as said fastener engaging portion.

7. The wrench of claim 1 wherein said pivoting joint rotates in a plane other than the plane in which said fastener engaging portion rotates.

8. A ratcheting device comprising:

a ratchet body;

a socket member;

a socket-biasing member adapted to bias said socket member against said ratchet body, said socket member movably engaged to said ratchet body; and a pawl, movably engaged with said socket member and with splines located along the circumference of a bore in said ratchet body, wherein said pawl is adapted to prevent movement of the ratchet device in a first direction when said pawl is in a first predetermined position, and wherein said pawl is adapted to prevent movement of the ratchet device in a second direction when said pawl is in a second predetermined position;

wherein said ratcheting device is adapted to allow movement of said pawl from said first predetermined position to said second predetermined position.

9. A ratcheting device according to claim 8, wherein said pawl is moved from said first predetermined position to said second predetermined position by pulling said socket member a predetermined distance away from said ratchet body and rotating said socket member in a predetermined direction.

10. A ratcheting device comprising:

a cylindrical ratchet body, said ratchet body further comprising:

(1) an internal bore in a second end of said ratchet body, said internal bore of a diameter less than the outer diameter of said ratchet body such that a cylindrical wall is formed within said ratchet body at said second end;

(2) an axial hole, said hole beginning at the terminus of said internal bore and continuing for some distance toward a first end of said ratchet body;

(3) splines uniformly arranged along the inner circumference of said cylindrical wall, said splines extending axially some distance from said second end toward said first end of said ratchet body;

a socket member, said socket member further comprising:

(1) a first cylindrical portion, said first cylindrical portion having a shaped recess at a first end for engaging a fastener;

(2) a second cylindrical portion for contacting a pawl, said second cylindrical portion extending axially from the center of a second end of said first cylindrical portion;

(3) a third cylindrical portion provided to protrude into said axial hole in said ratchet body and to contact a socket-biasing member located within said ratchet body;

(4) a flat surface for contacting said pawl, said flat surface extending axially the length of said second and third cylindrical portions;

(5) wall sections for engaging said pawl, said wall sections adjacent to each of both edges of said flat surface occurring in said second cylindrical portion, each wall section further forming a predetermined angle with respect to said flat surface;

(6) a tab of some thickness, extending vertically upward some distance from the outer surface of said second end of said first cylindrical portion; and (7) a retaining structure located on said flat surface of said second cylindrical portion for retaining a pawl-biasing member;

a socket-biasing member for biasing said socket member against said ratchet body;

a pawl, movably engaged with the inner circumference of said ratchet body, said pawl further comprising:

(1) sides angled inwardly from a front surface toward a back surface to form a wedge when in contact with either of said wall sections of said second cylindrical portion of said socket member;

(2) at least two splines on its front surface extending some distance along its length, and provided to engage said splines located within said ratchet body; and a pawl-biasing member, for biasing said pawl against said splines located within said ratchet body when said pawl is wedged against either of said wall sections formed in said second cylindrical portion of said socket member.

11. The ratcheting device of claim 10 wherein said cylindrical ratchet body has a slot along a first diameter of a first end, to allow insertion and pivoting of said pivot-forming structure of said wrench handle within said slot.

12. The ratcheting device of claim 10 wherein said cylindrical ratchet body has a hole located toward said first end, the axis of said hole lying along a second diameter such that said hole passes through each of the two sections of said ratchet body forming the lateral edges of said slot, said hole further oriented to be axially aligned with said hole in said pivot-forming structure of said wrench handle when said pivot-forming structure is properly inserted into said slot.

13. The ratcheting device of claim 10 wherein said cylindrical ratchet body has a notch in the bottom surface of said slot for engaging a socket-biasing member, said slot extending from said axial hole along said first diameter, said notch preferably of square or rectangular shape and of a width less than the diameter of said axial hole.

14. The ratcheting device of claim 10 wherein said cylindrical ratchet body has a circumferential groove around the inner cylindrical wall for retaining and guiding said pawl member, said circumferential groove of a diameter less than the outer diameter of said ratchet body and located between said splines and the terminus of said internal bore.

15. The ratcheting device of claim 10 wherein said second cylindrical portion of said socket member has a diameter less than the diameter of said first cylindrical portion.

16. The ratcheting device of claim 10 wherein said third cylindrical portion of said socket member has a diameter less than the diameter of said second cylindrical portion.

17. The ratcheting device of claim 10 wherein said flat surface of said socket member is formed to lie in a single plane, extending to some depth into both of said second and third cylindrical portions of said socket member.

18. The ratcheting device of claim 10 wherein said tab of said socket member also extends radially outward some distance from said flat surface of said second cylindrical portion.

19. The ratcheting device of claim 10 wherein said tab of said socket member is centered along said line formed by said intersection of said flat surface with said second end of said first cylindrical portion.

20. The ratcheting device of claim 10 wherein said tab of said socket member is designed to pivot said pawl out of engagement with said splines located within said ratchet body.

21. The ratcheting device of claim 10 wherein said pawl is of generally rectangular shape.

22. The ratcheting device of claim 10 wherein said pawl has a cap protruding from its front surface, said cap provided to engage said circumferential groove located within said ratchet body.

23. The ratcheting device of claim 10 wherein said third cylindrical portion of said socket member has a circumferential groove and said socket-biasing member is a retaining spring clip.

24. The ratcheting device of claim 10 wherein said retaining structure of said socket member comprises a hole, and said pawl-biasing member comprises a ball bearing and spring.

25. A ratcheting device comprising:

a cylindrical ratchet body, said ratchet body further comprising:

(1) an internal bore in a second end of said ratchet body, said internal bore of a diameter less than the outer diameter of said ratchet body such that a cylindrical wall is formed within said ratchet body at said second end;

(2) an axial hole, said hole beginning at the terminus of said internal bore and continuing for some distance toward a first end of said ratchet body;

(3) splines uniformly arranged along the inner circumference of said cylindrical wall, said splines extending axially some distance from said second end toward said first end of said ratchet body;

a coupling member, said coupling member further comprising:

(1) a first cylindrical portion, said first cylindrical portion having a protruding male connector at a first end for releasably engaging a socket;

(2) a second cylindrical portion for contacting a pawl, said second cylindrical portion extending axially from the center of a second end of said first cylindrical portion;

(3) a third cylindrical portion provided to protrude into said axial hole in said ratchet body and to contact a coupling-biasing member located within said ratchet body;

(4) a flat surface for contacting said pawl, said flat surface extending axially the length of said second and third cylindrical portions;

(5) wall sections for engaging said pawl, said wall sections adjacent to each of both edges of the flat surface occurring in said second cylindrical portion, each wall section forming a predetermined angle with respect to said flat surface;

(6) a tab of some thickness extending vertically upward some distance from the outer surface of said second end of said first cylindrical portion; and (7) a retaining structure located on said flat surface of said second cylindrical portion for retaining a pawl-biasing member;

a coupling-biasing member for biasing said coupling member against said ratchet body;

a pawl movably engaged with the inner circumference of said ratchet body, said pawl further comprising:

(1) sides angled inwardly from a front surface toward a back surface to form a wedge when in contact with either of said wall sections of said second cylindrical portion of said coupling member;

(2) at least two splines on its front surface extending some distance along its length, and provided to engage said splines located within said ratchet body; and a pawl-biasing member, for biasing said pawl against said splines located within said ratchet body when said pawl is wedged against either of said wall sections formed in said second cylindrical portion of said coupling member.

26. The ratcheting device of claim 25 wherein said cylindrical ratchet body has a slot along a first diameter of a first end, to allow insertion and pivoting of said pivot-forming structure of said wrench handle within said slot.

27. The ratcheting device of claim 25 wherein said cylindrical ratchet body has a hole located toward said first end, the axis of said hole lying along a second diameter such that said hole passes through each of the two sections of said ratchet body forming the lateral edges of said slot, said hole further oriented to be axially aligned with said hole in said pivot-forming structure of said wrench handle when said pivot-forming structure is properly inserted into said slot.

28. The ratcheting device of claim 25 wherein said cylindrical ratchet body has a notch in the bottom surface of said slot for engaging a coupling-biasing member, said slot extending from said axial hole along said first diameter, said notch preferably of square or rectangular shape and of a width less than the diameter of said axial hole.

29. The ratcheting device of claim 25 wherein said cylindrical ratchet body has a circumferential groove around the inner cylindrical wall for retaining and guiding said pawl member, said circumferential groove of a diameter less than the outer diameter of said ratchet body and located between said splines and the terminus of said internal bore.

30. The ratcheting device of claim 25 wherein said second cylindrical portion of said coupling member has a diameter less than the diameter of said first cylindrical portion.

31. The ratcheting device of claim 25 wherein said third cylindrical portion of said coupling member has a diameter less than the diameter of said second cylindrical portion.

32. The ratcheting device of claim 25 wherein said flat surface of said coupling member is formed to lie in a single plane, extending to some depth into both of said second and third cylindrical portions of said coupling member.

33. The ratcheting device of claim 25 wherein said tab of said coupling member also extends radially outward some distance from said flat surface of said second cylindrical portion.

34. The ratcheting device of claim 25 wherein said tab of said coupling member is centered along said line formed by said intersection of said flat surface with said second end of said first cylindrical portion.

35. The ratcheting device of claim 25 wherein said tab of said coupling member is designed to pivot said pawl out of engagement with said splines located within said ratchet body.

36. The ratcheting device of claim 25 wherein said pawl is of generally rectangular shape.

37. The ratcheting device of claim 25 wherein said pawl has a cap protruding from its front surface, said cap provided to engage said circumferential groove located within said ratchet body.

38. The ratcheting device of claim 25 wherein said third cylindrical portion has a circumferential groove and said coupling-biasing member is a retaining spring clip.

39. The ratcheting device of claim 25 wherein said retaining structure comprises a hole, and said pawl-biasing member comprises a ball bearing and spring.

40. The ratcheting device of claim 25 wherein said male connector of said coupling member has a spring loaded ball.

41. A method for reversing the direction of a ratcheting device, comprising the steps of:

pulling a socket member a predetermined distance away from a ratchet body;

rotating said socket member in a predetermined direction to move a pawl from a first predetermined position to a second predetermined position; and returning said socket member to a position abutting said ratchet body.

42. The method of claim 41 wherein said socket member is pulled axially away from said ratchet body.

43. The method of claim 41 wherein said socket member is biased against said ratchet body.

44. A method for reversing the direction of a ratcheting device, comprising the steps of:

pulling a coupling member a predetermined distance away from a ratchet body;

rotating said coupling member in a predetermined direction to move a pawl from a first predetermined position to a second predetermined position; and returning said coupling member to a position abutting said ratchet body.

45. The method of claim 44 wherein said coupling member is pulled axially away from said ratchet body.

46. The method of claim 44 wherein said coupling member is biased against said ratchet body.

47. A ratcheting device, comprising:

a ratchet body;

a socket member;

a socket-biasing member adapted to bias said socket member against said ratchet body, said socket member movably engaged to said ratchet body; and a pawl movably engaged with the inner circumference of said ratchet body, wherein said pawl is adapted to prevent movement of the ratchet device in a first direction when said pawl is in a first predetermined position, and wherein said pawl is adapted to prevent movement of the ratchet device in a second direction when said pawl is in a second predetermined position;

wherein said ratcheting device is adapted to allow movement of said pawl from said first predetermined position to said second predetermined position by pulling said socket member a predetermined distance away from said ratchet body and rotating said socket member in a predetermined direction.

48. A ratcheting device comprising:

a ratchet body, said ratchet body further comprising:

(1) an internal bore in a second end of said ratchet body, said internal bore of a diameter less than the outer dimension of said ratchet body such that a cylindrical wall is formed within said ratchet body at said second end;

(2) an axial hole, said hole beginning at the terminus of said internal bore and continuing for some distance toward a first end of said ratchet body;

(3) splines uniformly arranged along the inner circumference of said cylindrical wall, said splines extending axially some distance from said second end toward said first end of said ratchet body;

a socket member, said socket member further comprising:

(1) a first portion, said first portion having a shaped recess at a first end for engaging a fastener;

(2) a second, cylindrical portion for contacting a pawl, said second cylindrical portion extending axially from the center of a second end of said first cylindrical portion;

(3) a third, cylindrical portion provided to protrude into said axial hole in said ratchet body and to contact a socket-biasing member located within said ratchet body;

(4) a flat surface for contacting said pawl, said flat surface extending axially from said second end of said first cylindrical portion, through at least a portion of said second cylindrical portion;

(5) wall sections for engaging said pawl, said wall sections adjacent to each of both edges of said flat surface occurring in said second cylindrical portion, each wall section further forming a predetermined angle with respect to said flat surface;

(6) a tab of some thickness, extending vertically upward some distance from the outer surface of said second end of said first cylindrical portion; and (7) a retaining structure located on said flat surface of said second cylindrical portion for retaining a pawl-biasing member;

a socket-biasing member for biasing said socket member against said ratchet body;

a pawl, movably engaged with the inner circumference of said ratchet body, said pawl further comprising:

(1) sides shaped to form a wedge when in contact with either of said wall sections of said second cylindrical portion of said socket member;

(2) at least two splines on its front surface extending some distance along its length, and provided to engage said splines located within said ratchet body; and a pawl-biasing member, for biasing said pawl against said splines located within said ratchet body when said pawl is wedged against either of said wall sections formed in said second cylindrical portion of said socket member.

49. A ratcheting device comprising:

a ratchet body, said ratchet body further comprising:

(1) an internal bore in a second end of said ratchet body, said internal bore of a diameter less than the outer dimension of said ratchet body such that a cylindrical wall is formed within said ratchet body at said second end;

(2) an axial hole, said hole beginning at the terminus of said internal bore and continuing for some distance toward a first end of said ratchet body;

(3) splines uniformly arranged along the inner circumference of said cylindrical wall, said splines extending axially some distance from said second end toward said first end of said ratchet body;

a coupling member, said coupling member further comprising:

(1) a first portion, said first portion having a protruding male connector at a first end for releasably engaging a socket;

(2) a second, cylindrical portion for contacting a pawl, said second cylindrical portion extending axially from the center of a second end of said first cylindrical portion;

(3) a third, cylindrical portion provided to protrude into said axial hole in said ratchet body and to contact a coupling-biasing member located within said ratchet body;

(4) a flat surface for contacting said pawl, said flat surface extending axially from said second end of said first cylindrical portion, through at least a portion of said second cylindrical portion;

(5) wall sections for engaging said pawl, said wall sections adjacent to each of both edges of the flat surface occurring in said second cylindrical portion, each wall section forming a predetermined angle with respect to said flat surface;

(6) a tab of some thickness extending vertically upward some distance from the outer surface of said second end of said first cylindrical portion; and (7) a retaining structure located on said flat surface of said second cylindrical portion for retaining a pawl-biasing member;

a coupling-biasing member for biasing said coupling member against said ratchet body;

a pawl movably engaged with the inner circumference of said ratchet body, said pawl further comprising:

(1) sides shaped to form a wedge when in contact with either of said wall sections of said second cylindrical portion of said coupling member;

(2) at least two splines on its front surface extending some distance along its length, and provided to engage said splines located within said ratchet body; and a pawl-biasing member, for biasing said pawl against said splines located within said ratchet body when said pawl is wedged against either of said wall sections formed in said second cylindrical portion of said coupling member.

* * * * *